US007556054B2

(12) United States Patent
Zeigler

(10) Patent No.: US 7,556,054 B2
(45) Date of Patent: Jul. 7, 2009

(54) FOLDABLE FRAME ELEMENT AND SYSTEM WITH TENSION LOCK

(75) Inventor: Theodore R. Zeigler, Alexandria, VA (US)

(73) Assignee: World Shelters, Inc, Alexandria, VA (US)

( * ) Notice: Subject to any disclaimer, the term of this patent is extended or adjusted under 35 U.S.C. 154(b) by 464 days.

(21) Appl. No.: 11/458,443

(22) Filed: Jul. 19, 2006

(65) Prior Publication Data

US 2008/0017233 A1 Jan. 24, 2008

(51) Int. Cl.
*E04H 15/50* (2006.01)
*E04B 7/10* (2006.01)

(52) U.S. Cl. ..... 135/145; 135/131; 135/135; 52/646; 52/81.1; 52/109

(58) Field of Classification Search ..... 135/123, 135/130–131, 143–146, 157, 120.3, 906, 135/908; 52/63, 79.5, 80.1, 80.2, 81.1, 81.5, 52/641, 643–646, 109; 403/174, 217
See application file for complete search history.

(56) References Cited

U.S. PATENT DOCUMENTS 3,968,808 A 7/1976 Zeigler
4,026,313 A 5/1977 Zeigler
4,280,521 A 7/1981 Zeigler
4,290,244 A 9/1981 Zeigler
4,334,660 A 6/1982 Zeigler
4,437,275 A 3/1984 Zeigler
4,473,986 A 10/1984 Zeigler
4,512,097 A 4/1985 Zeigler
4,522,008 A 6/1985 Zeigler
4,561,618 A 12/1985 Zeigler
4,579,066 A 4/1986 Zeigler
4,637,180 A 1/1987 Zeigler
4,689,932 A 9/1987 Zeigler
4,747,239 A 5/1988 Zeigler
4,761,929 A 8/1988 Zeigler
4,800,663 A 1/1989 Zeigler
4,838,003 A 6/1989 Zeigler
4,942,686 A * 7/1990 Kemeny ..... 40/610
4,970,841 A 11/1990 Zeigler
RE33,710 E 10/1991 Zeigler
5,230,196 A 7/1993 Zeigler (Continued)

FOREIGN PATENT DOCUMENTS

FR 2849668 A1 * 7/2004

*Primary Examiner*—Winnie Yip
(74) *Attorney, Agent, or Firm*—WRB-IP LLP

(57) ABSTRACT

A frame element includes a first scissor including a first and a second strut pivotably connected to each other at a first pivot point, a second scissor including a third and a fourth strut pivotably connected to each other at a second pivot point, and a hub to which the first and the third strut are pivotably connected, the first and second scissors being pivotable about the hub between a closed position in which the first, second, third, and fourth struts are substantially parallel to one another and an open, locked position in which the first and third struts define a non-zero angle with each other and abutment portions of the second and fourth struts contact receiving portions of the third and first struts, respectively, and prevent the first and third struts from pivoting beyond the non-zero angle.

23 Claims, 6 Drawing Sheets

U.S. PATENT DOCUMENTS 5,274,980 A 1/1994 Zeigler
5,363,626 A * 11/1994 Hanninen ..... 52/639
5,444,946 A 8/1995 Zeigler
5,651,228 A 7/1997 Zeigler
5,701,923 A * 12/1997 Losi et al. ..... 135/131
5,943,837 A * 8/1999 Esser et al. ..... 52/646
6,141,934 A 11/2000 Zeigler
6,206,020 B1 * 3/2001 Lynch ..... 135/128
6,266,932 B1 * 7/2001 Van Tassel ..... 52/80.1
6,941,704 B2 * 9/2005 Chen et al. ..... 52/79.5
7,131,236 B2 * 11/2006 Sample et al. ..... 52/79.5

* cited by examiner

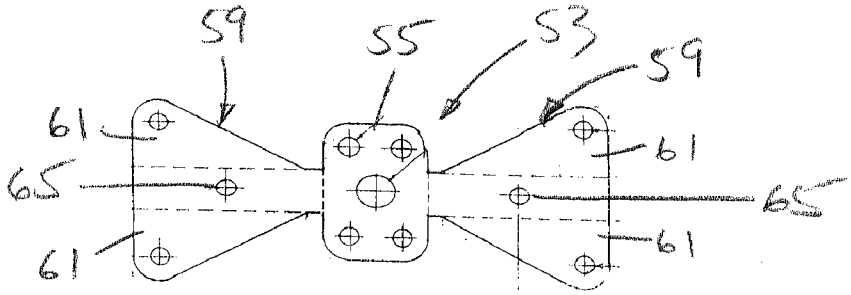
FIG. 4D
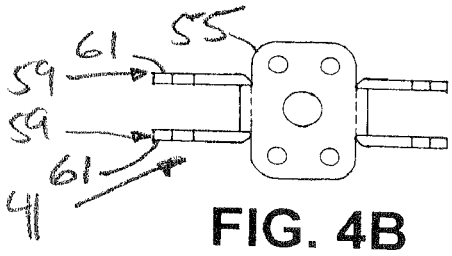
FIG. 4B
FIG. 4C
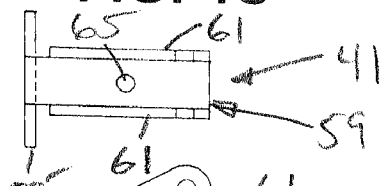
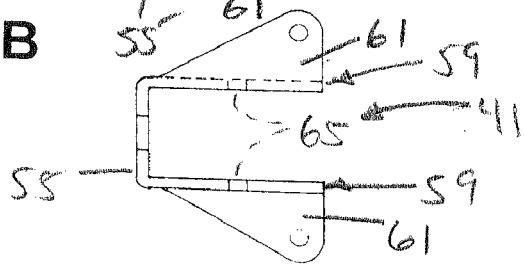
FIG. 4A
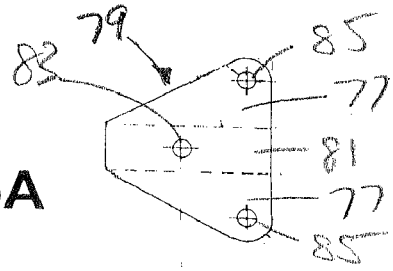
FIG. 5A
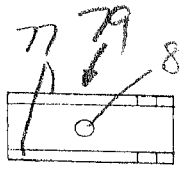
FIG. 5B
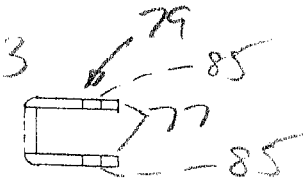
FIG. 5C
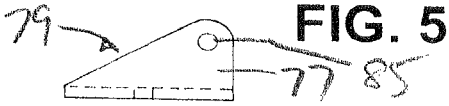
FIG. 5D

FOLDABLE FRAME ELEMENT AND SYSTEM WITH TENSION LOCK

BACKGROUND AND SUMMARY

The present invention relates to frame elements and systems and, more particularly, to foldable frame elements and systems.

Various folding frame systems for forming collapsible shelters and the like are known, such as those disclosed in my U.S. Pat. No. 5,230,196, U.S. Pat. No. 5,444,946, and U.S. Pat. No. 6,141,934, all of which are incorporated by reference. Those shelters, while generally well-suited for quick erection and for use in adverse environmental conditions, involve numerous parts and are designed for use for extended periods of time and in circumstances that can generally be anticipated. They are particularly useful in military applications where considerations of cost are secondary to the ability of the equipment to be successfully used under difficult environmental conditions.

In certain emergency situations, shelters such as those typically used by the military, while desirable, are often not practical. In disasters such as floods and earthquakes, the quantity of shelter needed for victims substantially exceeds the quantity of shelter available through collapsible shelters of the type purchased by the military. Moreover, the cost of such shelters, even if available, would be prohibitively expensive for most aid agencies and well beyond the means of the victims themselves.

Often, disaster victims are provided with crude shelters that are constructed out of any available materials, or provided with tents that are not intended for extended use. Usually, the shelters are poorly insulated and, in cold weather, they do not provide adequate protection from the elements. While these shelters are built or erected in the expectation that they will only be temporarily occupied, the reality is that the disaster victims often spend extended periods in these shelters. Survival is difficult where the shelters are not well-suited for adverse weather conditions.

It is desirable to provide a foldable frame system that is inexpensive to make, simple to erect, and that can be used as a disaster relief shelter, among various possible uses.

According to an aspect of the present invention, a frame element comprises a first scissor comprising a first and a second strut pivotably connected to each other at a first pivot point, a second scissor comprising a third and a fourth strut pivotably connected to each other at a second pivot point, and a hub to which the first and the third strut are pivotably connected, the first and second scissors being pivotable about the hub between a closed position in which the first, second, third, and fourth struts are substantially parallel to one another and an open, locked position in which the first and third struts define a non-zero angle with each other and abutment portions of the second and fourth struts contact receiving portions of the third and first struts, respectively, and prevent the first and third struts from pivoting beyond the non-zero angle.

According to another aspect of the present invention, a folding frame system comprises at least two frame elements, each frame element comprising a first scissor comprising a first and a second strut pivotably connected to each other at a first pivot point, a second scissor comprising a third and a fourth strut pivotably connected to each other at a second pivot point, and at least three hubs, each of the first, second, third, and fourth struts having first and second ends, the first ends of at least one of the first, second, third, and fourth struts being pivotably connected to at least one of the three hubs, the first and second scissors being pivotable about the hubs between a closed position in which the first, second, third, and fourth struts are substantially parallel to one another and an open, locked position in which the first and third struts define a non-zero angle with each other and abutment portions of the second and fourth struts contact receiving portions of the third and first struts, respectively, and prevent the first and third struts from pivoting beyond the non-zero angle, and at least three third scissors, each third scissor comprising a fifth and a sixth strut, the fifth strut being pivotably connected to one of the hubs and the sixth strut being pivotably connected to the second and fourth struts.

BRIEF DESCRIPTION OF THE DRAWINGS

The features and advantages of the present invention are well understood by reading the following detailed description in conjunction with the drawings in which like numerals indicate similar elements and in which:

FIGS. 4A-4C are front, top, and side views of a hub for a frame element according to an embodiment of the present invention, and FIG. 4D is a top view of a plate for forming the hub of FIGS. 4A-4C;

FIG. 5A is a top view of a plate for forming a pivot member of the type shown in front, top, and side views in FIGS. 5B-5D;

DETAILED DESCRIPTION

Figure 1A:
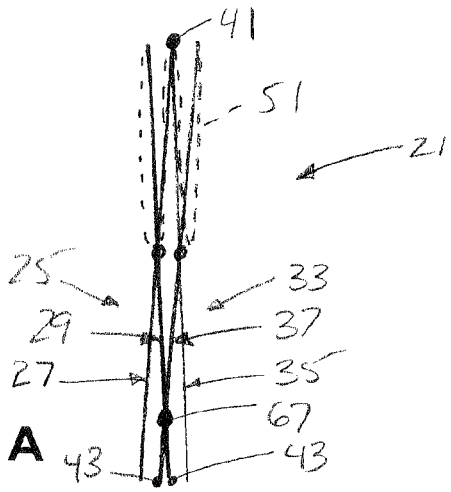
FIGS. 1A-1D are schematic views of a frame element according to an embodiment of the present invention in various stages between a closed position and an open, locked position.
Figure 1B:
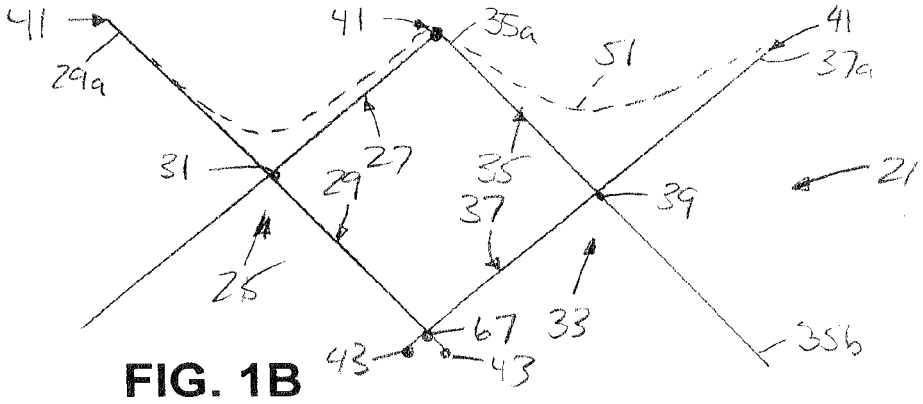
Figure 1C:
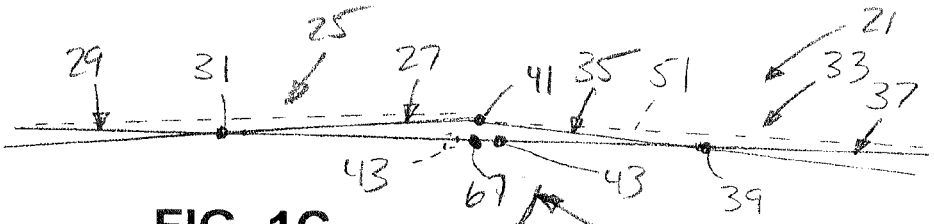
Figure 1D:
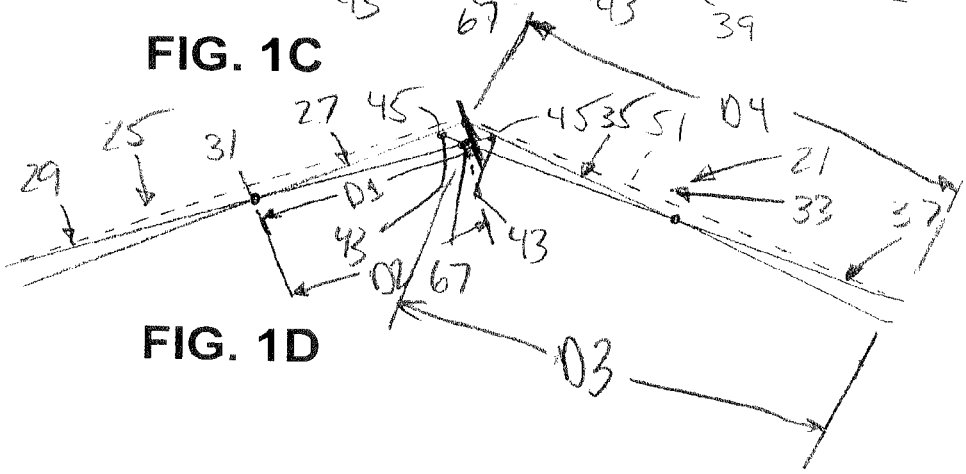

A frame element 21 according to an embodiment of the present invention and that is adapted for use in a folding frame system 23 (see FIGS. 3, 6, and 7A-7B) according to an embodiment of the present invention is shown in FIGS. 1A-1D. A folding frame system 23*a* is also shown in a folded condition in FIGS. 3 and 6. The frame element 21 comprises a first scissor 25 comprising a first and a second strut 27 and 29, respectively, pivotably connected to each other at a first pivot point 31. The frame element 21 also comprises a second scissor 33 comprising a third and a fourth strut 35 and 37 pivotably connected to each other at a second pivot point 39. The struts can be of a variety of suitable types, however, the illustrated struts are substantially square or rectangular elongated members.

Figure 2A:
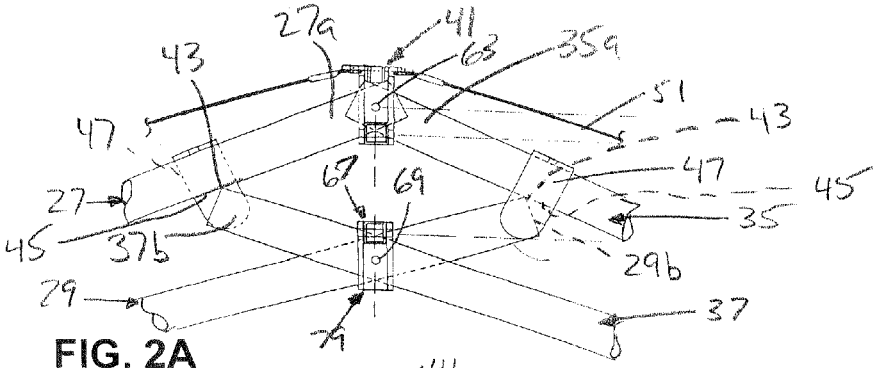
FIG. 2A is a side view of a portion of a frame element according to an embodiment of the present invention in an open, locked position.

An outer hub 41 to which the first and the third strut 27 and 35 are pivotably connected is provided. The first and second scissors 25 and 33 are pivotable about the outer hub 41 between a closed position (FIG. 1A) in which the first, second, third, and fourth struts 27, 29, 35, and 37, respectively, are substantially parallel to one another and an open, locked position (FIG. 1D) in which the first and third struts 27 and 35, respectively, define a non-zero angle with each other and, as seen in FIG. 2A, abutment portions 43 of the second and fourth struts 29 and 37, respectively, contact receiving portions 45 of the third and first struts, respectively, and prevent the first and third struts from pivoting beyond the non-zero angle.

Figure 2B:
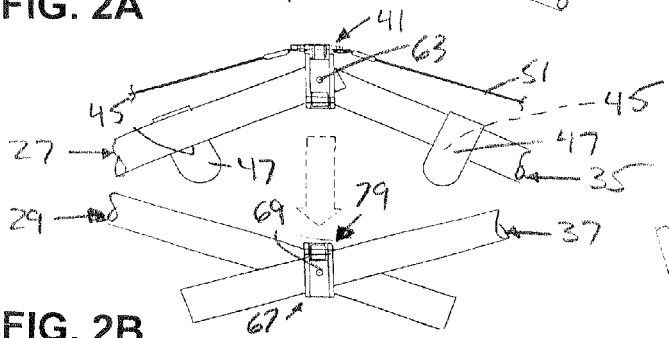
FIG. 2B is a side view of the frame element of FIG. 2A as it moves toward or from the open, locked position.

Ordinarily, the first and fourth struts 27 and 37 are pivotable in a substantially common plane, and the second and third struts 29 and 35 are pivotable in a substantially common plane. In this way, the abutment surfaces 43 of the second and fourth struts 29 and 37 are at or are themselves ends of the second and fourth struts. As seen in FIGS. 2A and 2B, a brace 47 can be provided on the first and third struts 27 and 35 proximate each receiving portion 45. The brace 47 can extend laterally from the first and third struts 27 and 35 and can assist in directing the abutment portions 43 to the receiving portions 45 and in preventing them from unintentionally disengaging. The brace 47 can be attached to the struts in any suitable fashion, such as by a fastener or by welding, brazing, or adhesives. The brace 47 can include an outwardly bent portion 47*a* that is bent to assist in guiding the abutment portions 43 to the receiving portions 45.

Figure 3:
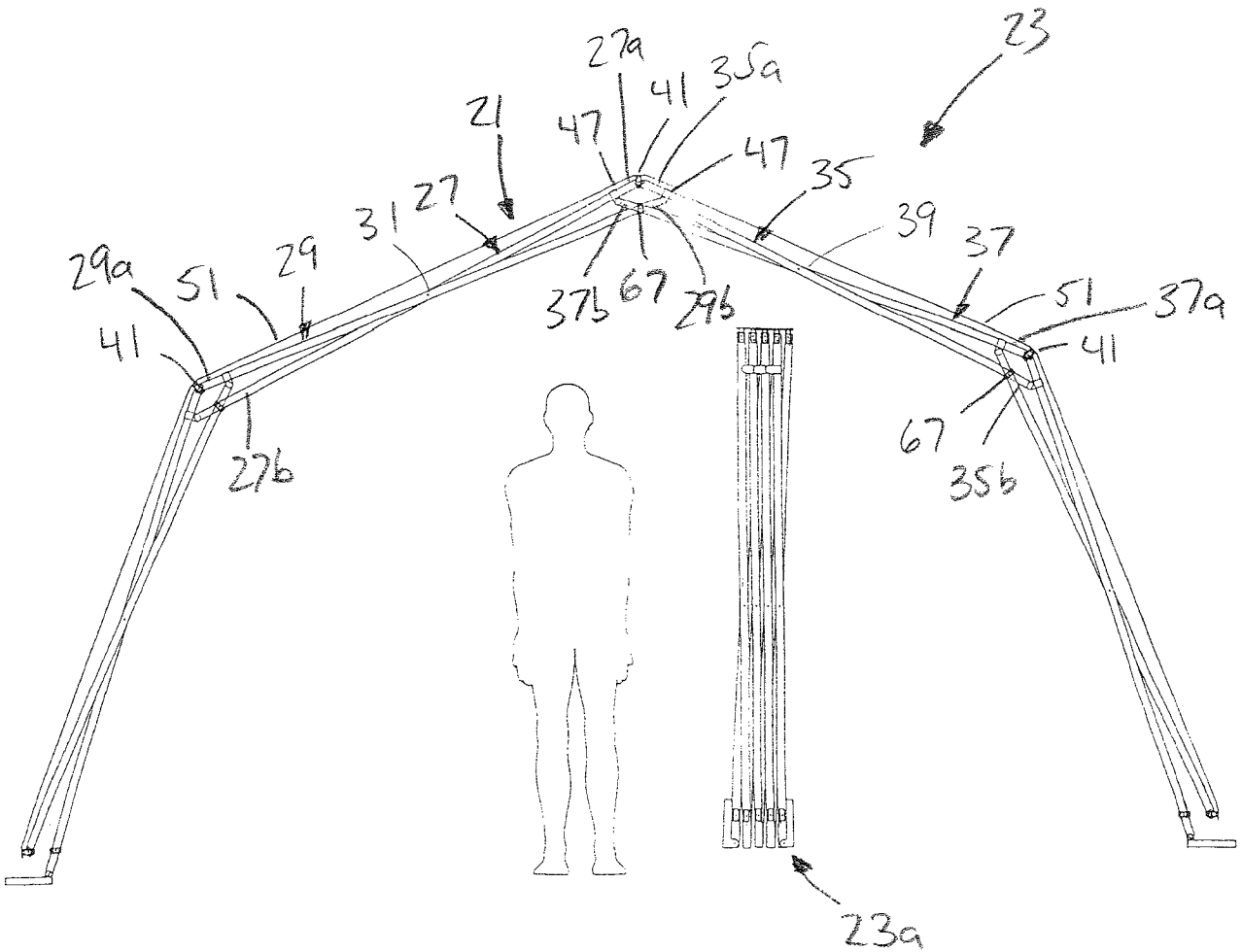
FIG. 3 is a side view of a frame system according to an embodiment of the present invention.

Each of the first, second, third, and fourth struts 27, 29, 35, and 37 have first and second ends 25*a* and 25*b*, 27*a* and 27*b*, 35*a* and 35*b*, and 37*a* and 37*b*. As seen in FIG. 3, the frame element 21 comprises at least three outer hubs 41, the first ends 27*a*, 29*a*, 35*a*, and 37*a* of at least one of the first, second, third, and fourth struts 27, 29, 35, and 37 being pivotably connected to at least one of the three outer hubs. In the frame element 21 shown in FIG. 3, the first ends 27*a* and 35*a* are both attached to one outer hub 41, the first end 29*a* is attached to a second outer hub, and the first end 37*a* is attached to the third outer hub. As additional scissors are added, additional hubs can be added.

Figure 2C:
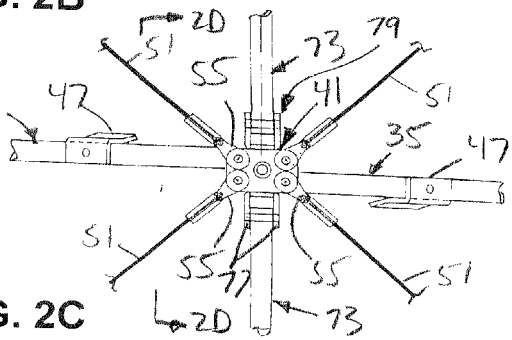
FIG. 2C is a top view of the frame element of FIG. 2A.

A tension member 51 extends between successive ones of each of the at least three outer hubs 41. The tension member 51 can be in the form of a cable, as shown, or can comprise a member such as a tent cover when the frame element 21 forms part of a system that is used as a shelter, such as a tent. Often, the system will have tension members 51 in the form of cables as well as a cover that also functions as a tension member. A hub 41 suitable for use as the outer hub is shown in FIGS. 4A-4C and can be formed from a single plate 53 as shown in FIG. 4D that is bent to form the outer hub. The hub 41 comprises a central tension member connection platform 55 to which cables or other tension members can be attached, such as by screws, bolts, or rivets through cable connectors 57 (FIG. 2D). Legs 59 are bent down from the central platform 55 and ears 61 are bent outwardly. The first ends 27*a* and 35*a* of the first and third struts 27 and 35 are pivotably connected to each other in side by side fashion, such as by a pin 63 (FIGS. 2A-2B) extending through each strut and through holes 65 in the legs.

The second and the fourth struts 29 and 37 are pivotably connected to each other at pivot points 67 intermediate the first and second pivot points 31 and 39 and the abutment portions 43 of the second and fourth struts. Like the first and third struts 27 and 35, the second and fourth struts 29 and 37 are pivotably connected to each other in side by side fashion, such as by a pin 69 extending through each strut.

In order to pivot the first and second scissors 25 and 33 from the closed position (FIG. 1A) to the open, locked position (FIG. 1D), the second and fourth struts 29 and 37 are moved from the closed position in which they define a 0° angle with each other and in which the tension member 51 is relaxed, to a more opened position (FIG. 1B) in which the second and fourth struts define an angle of less than 180° with each other and the tension member can begin to be placed under tension, to a transition position (FIG. 1C) in which the second and fourth struts define a 180° angle with each other and the tension member is under tension, to the open, locked position (FIG. 1D) in which the second and fourth struts define non-zero angle greater than 180° with each other and the tension member is under less tension than when the second and fourth struts are in the transition position. Locking of the struts in this manner is through what is referred to as a tension lock. Usually, either the tension member 51 is elastic to permit the first and second scissors 25 and 33 to move between the closed and the open positions or the first and second scissors are sufficiently flexible to permit the first and second scissors to move between the closed and the open positions, or both. The tension member may, alternatively, be connected between the outer hubs 41 after the first and second scissors 25 and 33 are moved to the closed position. In any event, the scissors 25 and 33, and thus, the frame element 21, will not be moved out of the open, locked position except by passing the second and fourth struts 29 and 37 through the transition position, which requires application of some force to overcome the force of the tension member 51.

Figure 6:
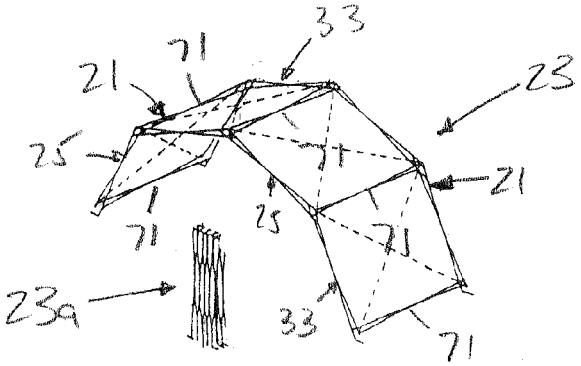
FIG. 6 is a perspective view of a frame system according to an embodiment of the present invention.

By designing the frame element 21 so that a distance D1 between the first pivot point 31 (or second pivot point 39) and a center of the outer hub 41 is greater than a distance D2 between the first pivot point (or second pivot point) and the intermediate pivot point 65, when the frame element is in the open, locked position, the distance D3 between the intermediate pivot points on the struts forming a scissor is less than the distance D4 between the centers of the outer hubs 41 on the struts forming the scissor. By positioning several such frame elements end to end (as seen in FIGS. 3 and 6), a convex arch shape can be made. If the distance D1 is equal to the distance D2, a straight shape (not shown) can be made. If the distance D1 is less than the distance D2, a concave shape (not shown) can be made. Elements for forming convex, straight, and concave shapes can also be combined in any desired manner to form still other shapes.

In the frame element 21, the first and second pivot points 31 and 39 are ordinarily parallel pivot axes so the scissors 25 and 33 are in substantially the same plane, although other embodiments (not shown) may have scissors that are not in substantially the same plane. In the frame element 21, a third scissor 71 comprising a fifth and a sixth strut 73 and 75 can be provided. The fifth strut 73 can be pivotably connected to the outer hub 41 and the sixth strut 75 can be pivotably connected to the second and fourth struts 29 and 37. In this embodiment, the third scissor 71 is substantially perpendicular to the first and second scissors 25 and 33 when the scissors are all in an open position. In embodiments where two third scissors 71 extend perpendicularly to a first and a second scissor, as seen in, e.g., FIGS. 2C and 2D, first ends 73*a* of first struts 73 can be connected to the outer hub 41 between the ears 61. Second ends 75*b* of the sixth struts 75 can be connected between ears 77 of pivot members 79 that can be secured proximate the second ends 29*b* and 37*b* of the second and fourth struts 29 and 37 by the pivot pin 69. The pivot members 79 can be made from a plate as seen in FIG. 5A by bending ears 77 outwardly from a central portion 81. A pivot member 79 is shown in FIGS. 5B-5D. The pivot pin 69 can extend through the second ends 29*b* and 37*b* of the second and fourth struts 29 and 37 and through holes 83 in the pivot members 79. A pivot pin can extend through holes 85 in the pivot members 79 to secure the second ends 75*b* of the sixth struts 75.

Figure 7A:
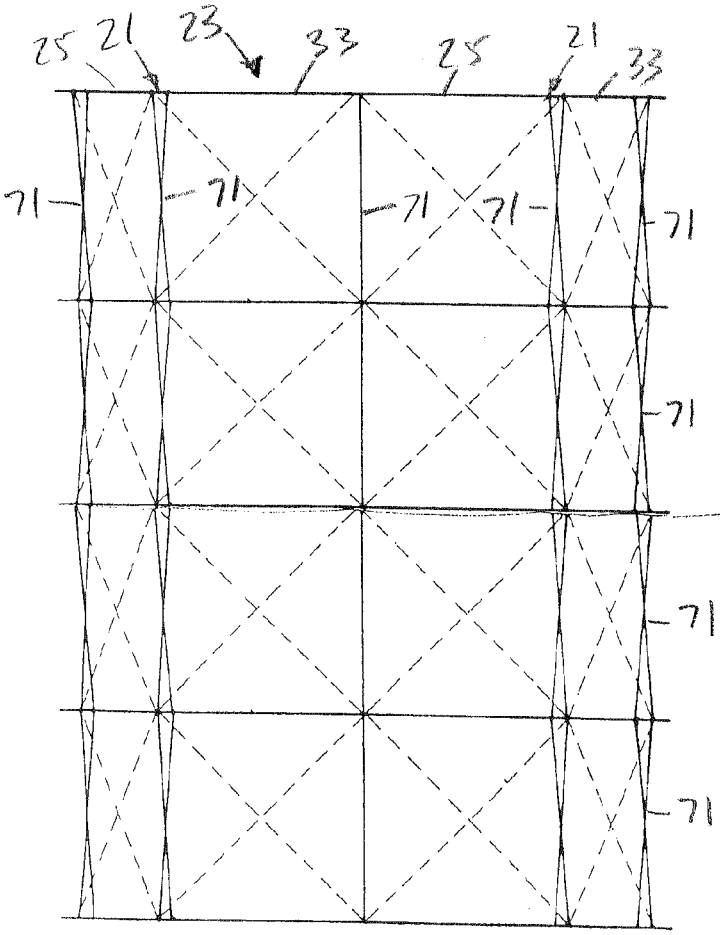
FIGS. 7A-7B are top and side views of a frame system according to an embodiment of the present invention.
Figure 7B:
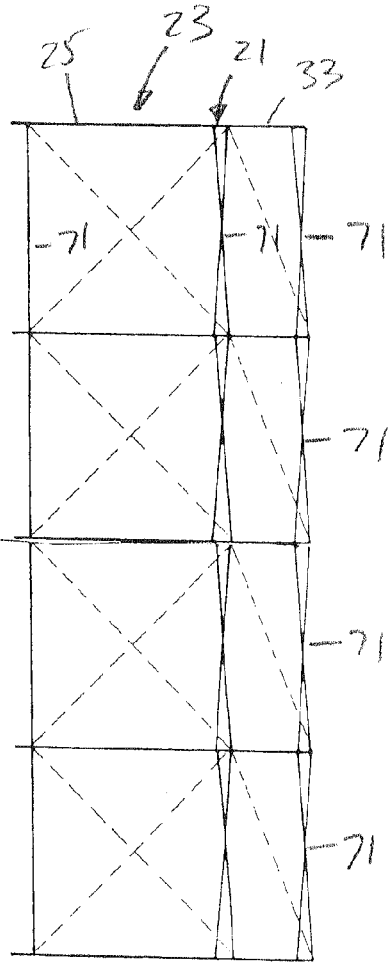

The folding frame systems 23 seen in FIGS. 3, 6, and 7A-7B comprise a plurality of frame elements 21. Frame elements 21 can be connected end-to-end as well as side-by-side. Structures (not shown) intermediate the frame elements may be provided in a folding frame system, as well. Generally, a plurality of folding frame elements 21, each comprising two pairs of scissors 25 and 33 will be connected to end-to-end to form a two-dimensional arch, as seen in FIG. 3. Additionally, a plurality of folding frame elements 21 comprising scissors 25 and 33 will be connected side-by-side by third scissors 71 to extend the arch in a third dimension, as seen in FIGS. 6 and 7A-7B. While the third scissors may include tension locking arrangements like the frame elements 21, ordinarily, the third scissors will merely be scissors with no locking except that provided by means of the tension lock obtained with the scissors 25 and 33.

Figure 2E:
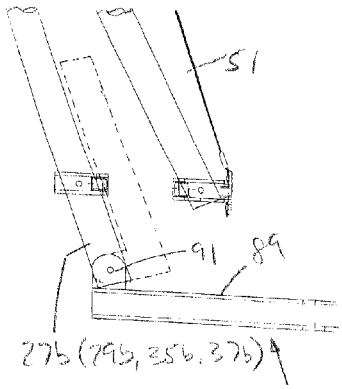
FIG. 2E is a side view of another portion of a frame element according to an embodiment of the present invention.
Figure 2D:
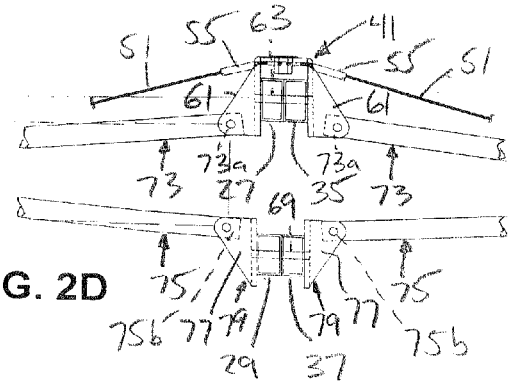
FIG. 2D is a partially cross-sectional view of the frame element of FIG. 2D taken at section 2D-2D of FIG. 2C.

As seen in, e.g., FIG. 2E, at least one foot member 87 can be pivotably attached to the second end 27*b*, 29*b*, 35*b*, or 37*b* of at least one of the first, second, third, and fourth struts 27, 29, 35, or 37. The foot member 87 can comprise an enlongated strut 89 that is pivotably attached by a flange 91 to the second end 27*b*, 29*b*, 35*b*, or 37*b* of an end one of at least one of the first, second, third, and fourth struts 27, 29, 35, or 37. The foot member 87 can be attached to an end one of the first end of the struts, instead of or in addition to being attached to an end one of the second ends of the struts.

Figure 8A:
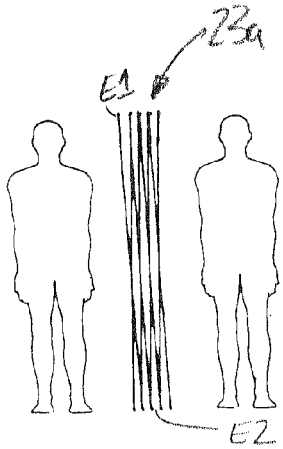
FIGS. 8A-8C are schematic views showing steps in a method according to an embodiment of the present invention for the erection of a frame system according to an embodiment of the present invention.
Figure 8B:
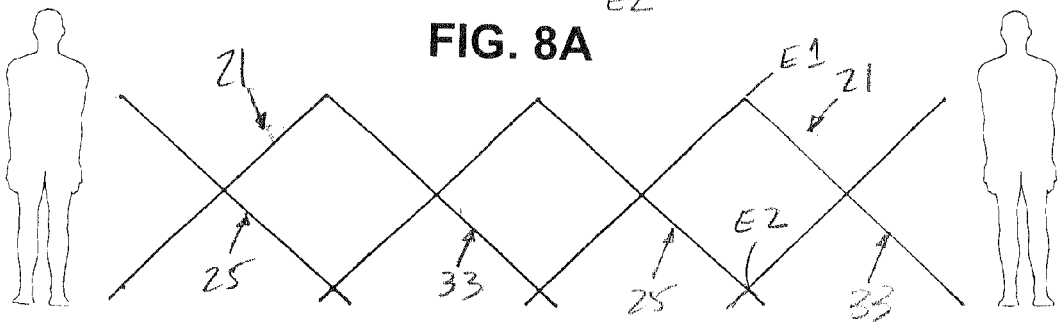
Figure 8C:
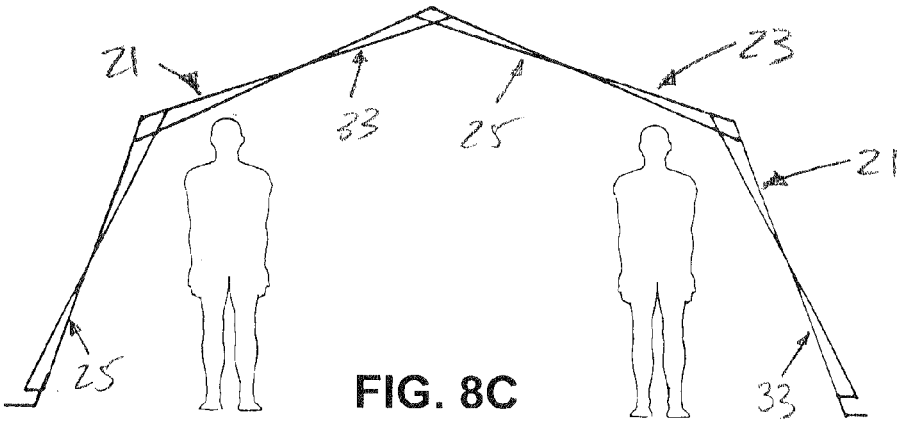

As seen in FIGS. 8A-8C, the frame system 23 is easily erected from the closed position as seen in FIG. 8A. In the closed position, the first ends E1 of all of the struts are distant from the second ends. As seen in FIG. 8B, the frame system 23 is opened from the closed position by moving the second ends E2 toward the first ends E1. Erection of the frame system 23 is completed by moving the second ends E2 toward the first ends E1 and past the transition point at which the tension member (not shown in FIGS. 8A-8C) is in maximum tension. Once the second ends E2 are past the transition point and the abutment portions of the second struts abut the receiving portions of the first struts, the frame system 23 will be collapsed only by moving the second ends of the second struts through the transition point again, which will ordinarily require effort.

A cover, not shown, may be provided on the exterior of the frame system before or after erection. Another cover may be provided on the interior of the frame system, ordinarily after erection. Insulation can be provided inside the outer cover and, if an inner cover is provided, between the inner and outer covers.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. A frame element, comprising:

a first scissor comprising a first and a second strut pivotably connected to each other at a first pivot point;

a second scissor comprising a third and a fourth strut pivotably connected to each other at a second pivot point; and a hub to which the first and the third strut are pivotably connected, the first and second scissors being pivotable about the hub between a closed position in which the first, second, third, and fourth struts are in a first substantially parallel relationship to one another and side-by-side, through an intermediate position in which the first and the third struts define a non-zero angle with each other and in which the second and fourth struts are substantially end-to-end and in a second substantially parallel relationship to each other and end-to-end, and to an open, locked position in which the first and third struts define the non-zero angle with each other, and the second and fourth struts define a second non-zero angle with each other and abutment portions of the second and fourth struts contact receiving portions of the third and first struts, respectively, and prevent the first and third struts from pivoting beyond the non-zero angle.

2. The frame element as set forth in claim 1, wherein the first and fourth struts are pivotable in a substantially common plane, and the second and third struts are pivotable in a substantially common plane.

3. The frame element as set forth in claim 2, wherein the abutment surfaces of the second and fourth struts are ends of the second and fourth struts.

4. The frame element as set forth in claim 3, further comprising a brace on the first and third struts proximate each receiving portion.

5. The frame element as set forth in claim 1, wherein each of the first, second, third, and fourth struts have first and second ends, the frame element comprising at least three hubs, the first ends of at least one of the first, second, third, and fourth struts being pivotably connected to at least one of the three hubs.

6. The frame element as set forth in claim 5, comprising a tension member extending between successive ones of each of the at least three hubs.

7. The frame element as set forth in claim 1, comprising a tension member associated with the first and the second scissor for retaining the first and the second scissor in the open, locked position.

8. The frame element as set forth in claim 1, wherein the first and second pivot points are parallel pivot axes.

9. The frame element as set forth in claim 1, comprising a third scissor comprising a fifth and a sixth strut, the fifth strut being pivotably connected to the hub and the sixth strut being pivotably connected to the second and fourth struts.

10. The frame element as set forth in claim 9, wherein the third scissor is substantially perpendicular to the first and second scissors when the first, second, and third scissors are in an open position.

11. A frame element, comprising:

a first scissor comprising a first and a second strut pivotably connected to each other at a first pivot point;

a second scissor comprising a third and a fourth strut pivotably connected to each other at a second pivot point;

a hub to which the first and the third strut are pivotably connected, the first and second scissors being pivotable about the hub between a closed position in which the first, second, third, and fourth struts are substantially parallel to one another and an open, locked position in which the first and third struts define a non-zero angle with each other and abutment portions of the second and fourth struts contact receiving portions of the third and first struts, respectively, and prevent the first and third struts from pivoting beyond the non-zero angle, wherein each of the first, second, third, and fourth struts have first and second ends, the frame element comprising at least three hubs, the first ends of at least one of the first, second, third, and fourth struts being pivotably connected to at least one of the three hubs; and a tension member extending between successive ones of each of the at least three hubs, wherein the second and the fourth struts are pivotably connected to each other at pivot points intermediate the first and second pivot points and the abutment portions of the second and fourth struts.

12. The frame element as set forth in claim 11, wherein, in order to pivot the first and second scissors from the closed position to the open, locked position, the second and fourth struts are moved from a closed position in which they define a 0° angle with each other and in which the tension member is relaxed, to a transition position in which the second and fourth struts define a 180° with each other and the tension member is under tension, to the open, locked position in which the second and fourth struts define non-zero angle greater than 180° with each other and the tension member is under less tension than when the second and fourth struts are in the transition position.

13. The frame element as set forth in claim 12, wherein the tension member is elastic to permit the first and second scissors to move between the closed and the open positions.

14. The frame element as set forth in claim 13, wherein the first and second scissors are flexible to permit the first and second scissors to move between the closed and the open positions.

15. The frame element as set forth in claim 12, wherein the first and second scissors are flexible to permit the first and second scissors to move between the closed and the open positions.

16. The frame element as set forth in claim 12, wherein a distance between the first pivot point and a center of the hub is greater than a distance between the first pivot point and the intermediate pivot point.

17. A frame element, comprising:

a first scissor comprising a first and a second strut pivotably connected to each other at a first pivot point;

a second scissor comprising a third and a fourth strut pivotably connected to each other at a second pivot point; and a hub to which the first and the third strut are pivotably connected, the first and second scissors being pivotable about the hub between a closed position in which the first, second, third, and fourth struts are substantially parallel to one another and an open, locked position in which the first and third struts define a non-zero angle with each other and abutment portions of the second and fourth struts contact receiving portions of the third and first struts, respectively, and prevent the first and third struts from pivoting beyond the non-zero angle; and a tension member associated with the first and the second scissor for retaining the first and the second scissor in the open, locked position, wherein the second and the fourth struts are pivotably connected to each other at points intermediate the first and second pivot points and the abutment portions of the second and fourth struts.

18. The frame element as set forth in claim 17, wherein, in order to pivot the first and second scissors from the closed position to the open, locked position, the second and fourth struts are moved from a closed position in which they define a 0° angle with each other and in which the tension member is relaxed, to a transition position in which the second and fourth struts define a 180° with each other and the tension member is under tension, to the open, locked position in which the second and fourth struts define non-zero angle greater than 180° with each other and the tension member is under less tension than when the second and fourth struts are in the transition position.

19. A folding frame system, comprising:

at least two frame elements, each frame element comprising a first scissor comprising a first and a second strut pivotably connected to each other at a first pivot point, a second scissor comprising a third and a fourth strut pivotably connected to each other at a second pivot point, and at least three hubs, each of the first, second, third, and fourth struts having first and second ends, the first ends of at least one of the first, second, third, and fourth struts being pivotably connected to at least one of the three hubs, the first and second scissors being pivotable about the hubs between a closed position in which the first, second, third, and fourth struts are in a first substantially parallel relationship to one another and side-by-side, through an intermediate position in which the first and the third struts define a non-zero angle with each other and in which the second and fourth struts are substantially end-to-end and in a second substantially parallel relationship to each other and end-to-end, and to an open locked position in which the first and third struts define the non-zero angle with each other, and the second and fourth struts define a second non-zero angle with each other and abutment portions of the second and fourth struts contact receiving portions of the third and first struts, respectively, and prevent the first and third struts from pivoting beyond the non-zero angle; and at least three third scissors, each third scissor comprising a fifth and a sixth strut, the fifth strut being pivotably connected to one of the hubs and the sixth strut being pivotably connected to the second and fourth struts.

20. The folding frame system as set forth in claim 19, wherein the third scissors are substantially perpendicular to the first and second scissors when the first, second, and third scissors are in an open position.

21. The folding frame system as set forth in claim 20, comprising a tension member associated with the first and the second scissor for retaining the first and the second scissor in the open, locked position.

22. The folding frame system as set forth in claim 21, wherein the tension member comprises a cover attached to the hubs.

23. The folding frame system as set forth in claim 19, comprising at least one foot member pivotably attached to the second end of at least one of the first, second, third, and fourth struts.

* * * * *